US009969184B2

(12) United States Patent
Isozaki et al.

(10) Patent No.: US 9,969,184 B2
(45) Date of Patent: May 15, 2018

(54) DROPLET EJECTION DEVICE

(71) Applicant: FUJI XEROX CO., LTD., Tokyo (JP)

(72) Inventors: Jun Isozaki, Kanagawa (JP); Akira Sakamoto, Kanagawa (JP); Takehiro Niitsu, Kanagawa (JP); Hiroyuki Tsukuni, Kanagawa (JP); Yukari Motosugi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days. days.

(21) Appl. No.: 15/368,819

(22) Filed: Dec. 5, 2016

(65) Prior Publication Data

US 2018/0001668 A1 Jan. 4, 2018

(30) Foreign Application Priority Data

Jun. 29, 2016 (JP) ..... 2016-129335

(51) Int. Cl.
*B41J 2/01* (2006.01)
*B41J 11/00* (2006.01)

(52) U.S. Cl.
CPC ..... *B41J 11/002* (2013.01)

(58) Field of Classification Search
CPC ..... B41J 11/002; B41J 29/393; B41J 29/38; B41J 2/473; B41J 2/01; B41J 2/45
USPC ..... 347/19, 102
See application file for complete search history.

(56) References Cited

U.S. PATENT DOCUMENTS 7,370,955 B2 * 5/2008 Yokoyama ..... B41J 11/002 347/100

FOREIGN PATENT DOCUMENTS

| | | |
|---|---|---|
| JP | 2007-111984 | 5/2007 |
| JP | 2007-125876 | 5/2007 |
| JP | 4400541 | 11/2009 |
| JP | 4534809 | 6/2010 |
| JP | 2016-013626 | 1/2016 |

OTHER PUBLICATIONS

Abstract and machine translation of JP2007-125876.
Abstract and machine translation of JP4400541.
Abstract and machine translation of JP2007-111984.
Abstract and machine translation of JP4534809.
Abstract and machine translation of JP2016-013626.

* cited by examiner

*Primary Examiner* — Jannelle M Lebron
(74) *Attorney, Agent, or Firm* — Fildes & Outland, P.C.

(57) ABSTRACT

A droplet ejection device includes: a droplet ejection head that ejects a droplet to a recording medium; an irradiating portion that evaporates moisture of the droplet landed on the recording medium by irradiating the recording medium with infrared laser beam; and a light shielding member that includes an upper light shielding member provided on a perimeter of the irradiating portion and a lower light shielding member provided on a position facing the irradiating portion and the upper light shielding portion while placing the recording medium therebetween, in which the upper light shielding portion and the lower light shielding portion are in contact with each other at an outside of the recording medium in the width direction so that the light shielding member shields the infrared laser beam at least in the width direction of the recording medium.

13 Claims, 9 Drawing Sheets

DROPLET EJECTION DEVICE

CROSS-REFERENCE TO RELATED APPLICATIONS

This application is based on and claims priority under 35 USC 119 from Japanese Patent Application No. 2016-129335 filed on Jun. 29, 2016.

BACKGROUND OF THE INVENTION

Technical Field

The present invention relates to a droplet ejection device.

SUMMARY

An aspect of the invention provides a droplet ejection device including:

a droplet ejection head that ejects a droplet to a recording medium;

an irradiating portion that is disposed closer to a downstream side of the recording medium in a transport direction than the droplet ejection head and evaporates moisture of the droplet landed on the recording medium by irradiating the recording medium with infrared laser beam; and a light shielding member that includes an upper light shielding member which is provided on a perimeter of the irradiating portion and a lower light shielding member which is provided on a position facing the irradiating portion and the upper light shielding portion while placing the recording medium therebetween, wherein the upper light shielding portion and the lower light shielding portion are in contact with each other at an outside of the recording medium in the width direction so that the light shielding member shields the infrared laser beam at least in the width direction of the recording medium.

BRIEF DESCRIPTION OF THE DRAWINGS

Exemplary embodiment(s) of the present invention will be described in detail based on the following figures, wherein.

DETAILED DESCRIPTION

Hereinafter, with reference to the drawings, an exemplary embodiment according to the present invention will be described in detail. For convenience of explanation, an arrow UP appropriately indicated in each of the drawings refers to the upper direction of an inkjet recording device 10 as an example of a droplet ejection device and an arrow FW refers to the transport direction of a continuous paper P as an example of a recording medium. In addition, in the following, there are cases where the transport direction of the continuous paper P is simply referred as "transport direction" and an upstream side and a downstream side of the transport direction thereof are simply referred to as "upstream side" and "downstream side", respectively. In addition, when viewed from the upper side (in a plan view), a direction which is perpendicular to the transport direction of the continuous paper P is referred to as "width direction" and is indicated as an arrow W in FIG. 3, FIG. 7 to FIG. 9.

Figure 1:
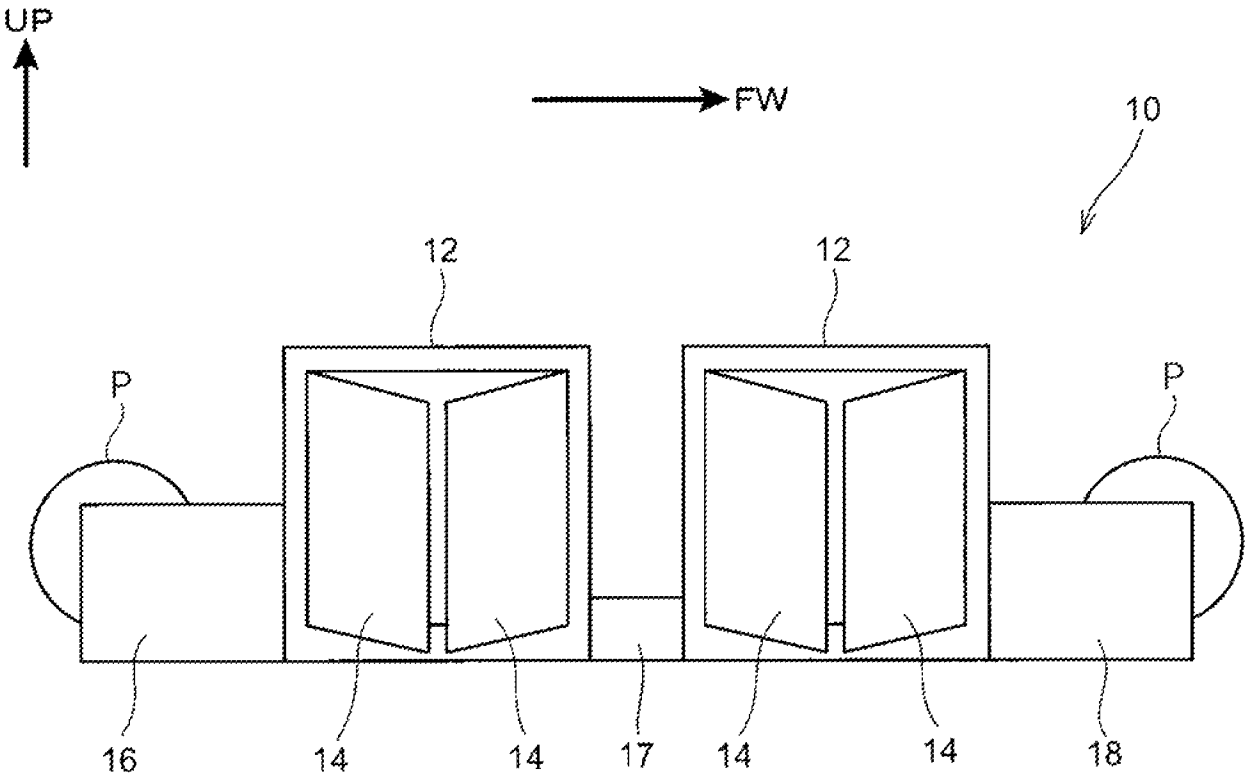
FIG. 1 is side view illustrating appearance of an inkjet recording device according to an exemplary embodiment.
Figure 2:
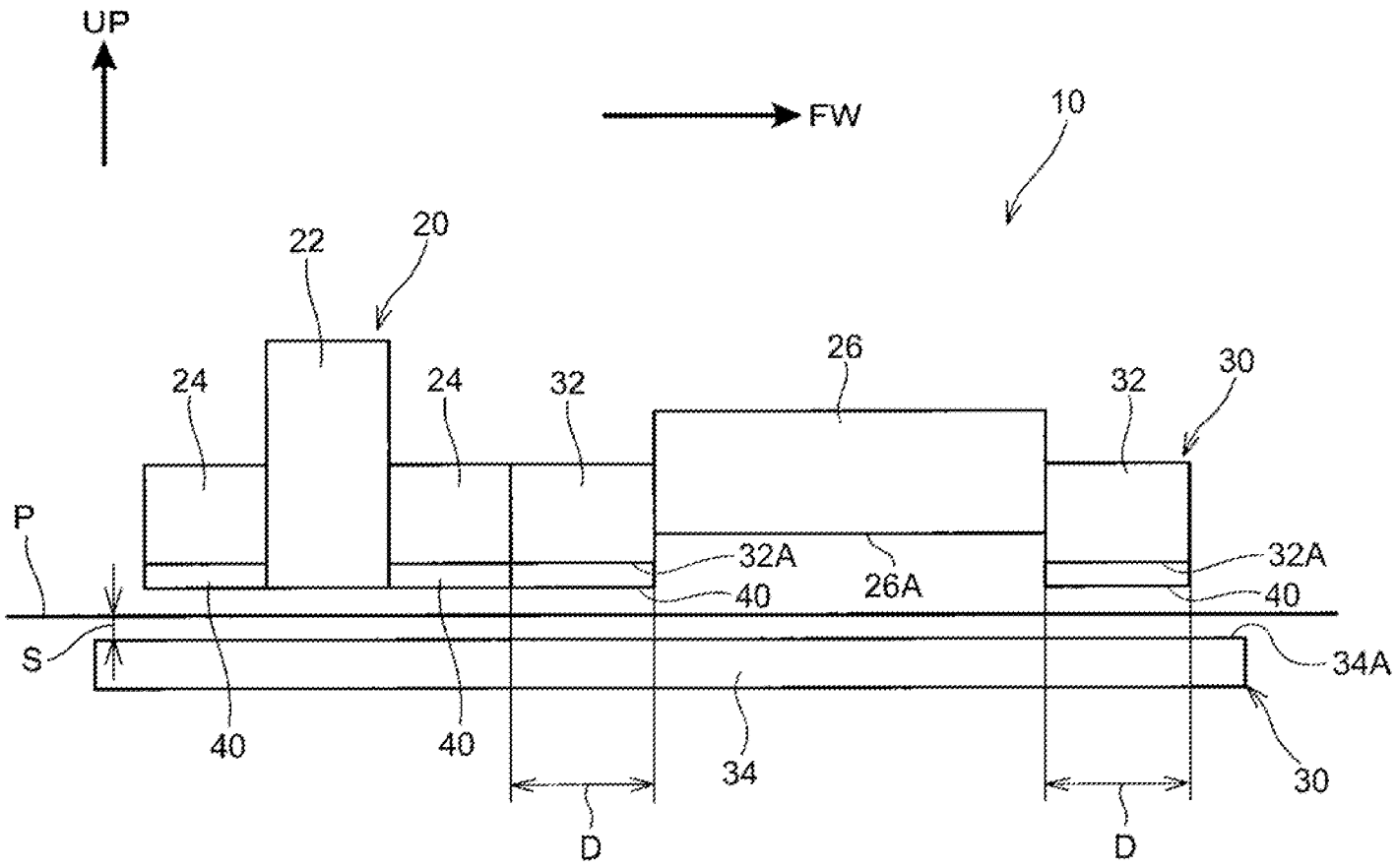
FIG. 2 is a side view illustrating a configuration of an image forming portion of the inkjet recording device according to the exemplary embodiment.

First Exemplary Embodiment:

An inkjet recording device 10 according to a first exemplary embodiment will be described. As illustrated in FIG. 1 and FIG. 2, the inkjet recording device 10 includes an image forming portion 20 in an accommodation chamber 12. The image forming portion 20 is configured to include an inkjet recording head 22 as an example of a droplet ejection head that ejects ink droplets (droplets) on an upper surface of an continuous paper P and forms an image on the upper surface of the continuous paper P, a irradiating portion 26 that irradiates the continuous paper P on which the ink droplets are landed with an infrared laser beam, and a light shielding member 30 that inhibits or prevents the infrared laser beam from being leaked to an outer.

As illustrated in FIG. 1, the accommodation chamber 12 has a door 14 which is capable of being opened and closed, and is configured not to irradiate with the infrared laser beam from the irradiating portion 26 in a state where the door 14 is opened. Specifically, for example, if a control portion (not illustrated) which is provided on the inkjet recording device 10 does not detect a state the door 14 is closed, the accommodation chamber is configured as an interlock mechanism which is not energized to the irradiating portion 26.

The continuous paper P is wound into a roll and is disposed on a sending portion 16 and is adapted to be fed from the sending portion 16 to an inside of the accommodation chamber 12. Therefore, the printed continuous paper P discharged from the inside of the accommodation chamber 12 is adapted to be wound into a roll in a winding portion 18. Two (for a surface and for a back surface) accommodation chambers 12 is capable of being provided in the inkjet recording device 10 so that print is performed on both the surface and the back surface of the continuous paper P and an inversion portion 17 which inverses the surface and the back surface of the continuous paper P between the accommodation chamber 12 for the surface and the accommodation chamber 12 for the back surface is provided.

Figure 3:
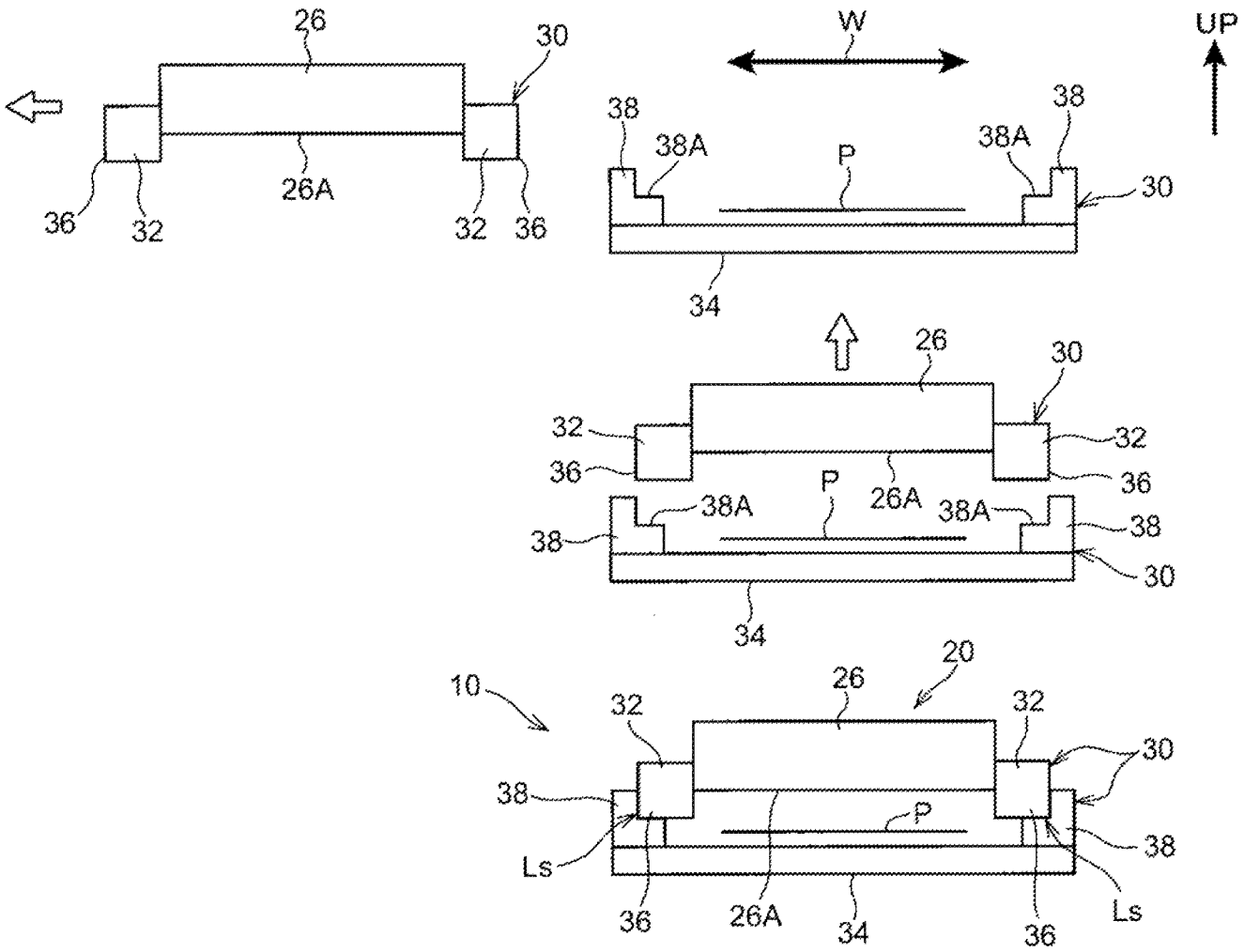
FIG. 3 is an explanation view illustrating a configuration of an outside portion of a light shielding member in the width direction according to a first exemplary embodiment.

As illustrated in FIG. 2 and FIG. 3, in the inkjet recording head 22, the width direction of the continuous paper P which is transported along a transport path configured by plural guide rolls 13 which are provided in the accommodation chamber 12 (see FIG. 4 to FIG. 6), or the like is the longitudinal direction, the inkjet recording head 22 has a length which is equal to greater than a paper width of the continuous paper P. In FIG. 3, the irradiating portion 26 is indicated and a length of the inkjet recording head 22 in the width direction is substantially the same as that of the irradiating portion 26.

In addition, in the inkjet recording head 22, black (K), cyan (C), magenta (M), and yellow (Y) are disposed in plural numbers and in this order from an upstream side of the continuous paper P in the transport direction, and each inkjet recording head 22 ejects the ink droplets of each color in turn from an upper side to the continuous paper P. Only the inkjet recording head 22 of black (K) of a most upstream side in the transport direction is illustrated in FIG. 2.

In addition, each inkjet recording head 22 is hold by being inserted into a holding member 24 formed in a rectangular frame shape and is disposed on the upper side of the continuous paper P which is transported along the transport path (an upper side of a lower light shielding portion 34 which constitutes the light shielding member 30). The holding member 24 holding each inkjet recording head 22 is configured to be capable of being lifted and to be capable of is moved in the width direction of the continuous paper P by a known moving mechanism (not illustrated).

The irradiating portion 26 which irradiates the continuous paper P which is transported along the transport path (the upper side of the lower light shielding portion 34) with the infrared laser beam is disposed on an downstream side of the inkjet recording head 22 (including the holding member 24) in the transport direction. The irradiating portion 26 is configured as a vertical resonator type surface light emitting laser irradiating device having class 4 or more high output since there is a need to dry the ink droplets (to evaporate moisture from the ink droplets containing a pigment and the moisture) in a short time of a few tens of milliseconds to several hundred milliseconds, for example.

An upper light shielding portion 32 constituting the light shielding member 30 is provided in a periphery of the irradiating portion 26. In other words, the irradiating portion 26 is hold by inserting into the upper light shielding portion 32 formed in a rectangular frame shape and is disposed on the upper side of the continuous paper P which is transported along the transport path (the upper side of the lower light shielding portion 34). The moisture in an image (the ink droplets) formed on the continuous paper P is evaporated by the infrared laser beam which is irradiated from the irradiating portion 26.

As illustrated in FIG. 3, the upper light shielding portion 32 which is disposed on an outside of the irradiating portion 26 in the width direction constitutes a fitting portion 36 having a section of a rectangular shape. In addition, a glass plate is provided on a lower surface 26A of the irradiating portion 26 and as illustrated in FIG. 2, the lower surface 26A (glass plate) of the irradiating portion 26 is positioned on the upper position than the lower surface 32A of the upper light shielding portion 32. Therefore, a light absorbing portion 40 which absorbs the infrared laser beam reflected from the continuous plate P is provided on the lower surface 32A of the upper light shielding portion 32 which is disposed on the upstream and the downstream of the irradiating portion 26 in the transport direction.

Specifically, nickel plating as the light absorbing portion 40 is applied on the lower surface 32A of the upper light shielding portion 32 which is disposed on the upstream side and the downstream side of the irradiating portion 26 in the transport direction. A length D of the light absorbing portion 40 (the upper light shielding portion 32 which is disposed on the upstream side and the downstream side of the irradiating portion 26 in the transport direction) in the transport direction is equal to or greater than 20 mm. In addition, the light absorbing portion 40 is also provided on the lower surface of the holding member 24 which holds the inkjet recording head 22 and may be configured to absorb the infrared laser beam reflected from the continuous paper P.

In addition, the infrared laser beam transmits through the order of a few % to 20% in a blank portion of the continuous paper P. Therefore, as illustrated in FIG. 2 and FIG. 3, the lower light shielding portion 34 constituting the light shielding member 30 together with the upper light shielding portion 32 is provided on the position facing the irradiating portion 26 and upper light shielding portion 32 in the vertical direction while placing the continuous paper P therebetween. A length along the transport direction of an outside part (fitted portion 38 to be described below) of the lower light shielding portion 34 in the width direction is equal to or greater than a length along the transport direction of an outside part (fitting portion 36) of the upper light shielding portion 32 in the width direction.

The outside part of the lower light shielding portion 34 in the width direction constitutes the fitted portion 38 having a section of substantially "L" shape in which an inside in the width direction is cut and has a configuration in which the fitting portion 36 of the upper light shielding portion 32 is fitted in a notch portion 38A of the fitted portion 38. Accordingly, the light shielding member 30 having a tunnel shape through which the continuous paper P is capable of being passed in the transport direction is formed and a labyrinthine structure Ls having a bent shape in a mating surface of the fitting portion 36 and the fitted portion 38, in cross section view viewed from the transporting direction is formed on the outside of the continuous paper P in the width direction (on the outside of the light shielding member 30 in the width direction).

A surface which is in contact with the upper light shielding portion 32 and the lower light shielding portion 34 may be a flat surface and the infrared laser beam is further shielded at least in the width direction of the continuous paper P by such a labyrinthine structure Ls being formed. Therefore, leakage of the infrared laser beam to the upstream side and the downstream side of the continuous paper P in the transport direction is configured to be inhibited by the infrared laser beam being absorbed with the light absorbing portion 40 which is provided on the lower surface of the upper light shielding portion 32 disposed on the upstream side and the downstream side of the irradiating portion 26 in the transport direction. The labyrinthine structure Ls may be formed by the mating surface of the fitting portion 36 and the fitted portion 38 being a curved shape.

In addition, as illustrated in FIG. 3, the upper light shielding portion 32 is also configured to be capable of being lifted integrally with the irradiating portion 26 and to be capable of being moved in the width direction of the continuous paper P, by a known moving mechanism (not illustrated). The known moving mechanism is considered as a configuration in which a member which supports the upper light shielding portion 32 which is formed integrally with the irradiating portion 26 is lifted and moved along a guide rail by being driven by an electric motor, for example. However, the moving mechanism in the present exemplary embodiment is not particularly limited to this.

Figure 4:
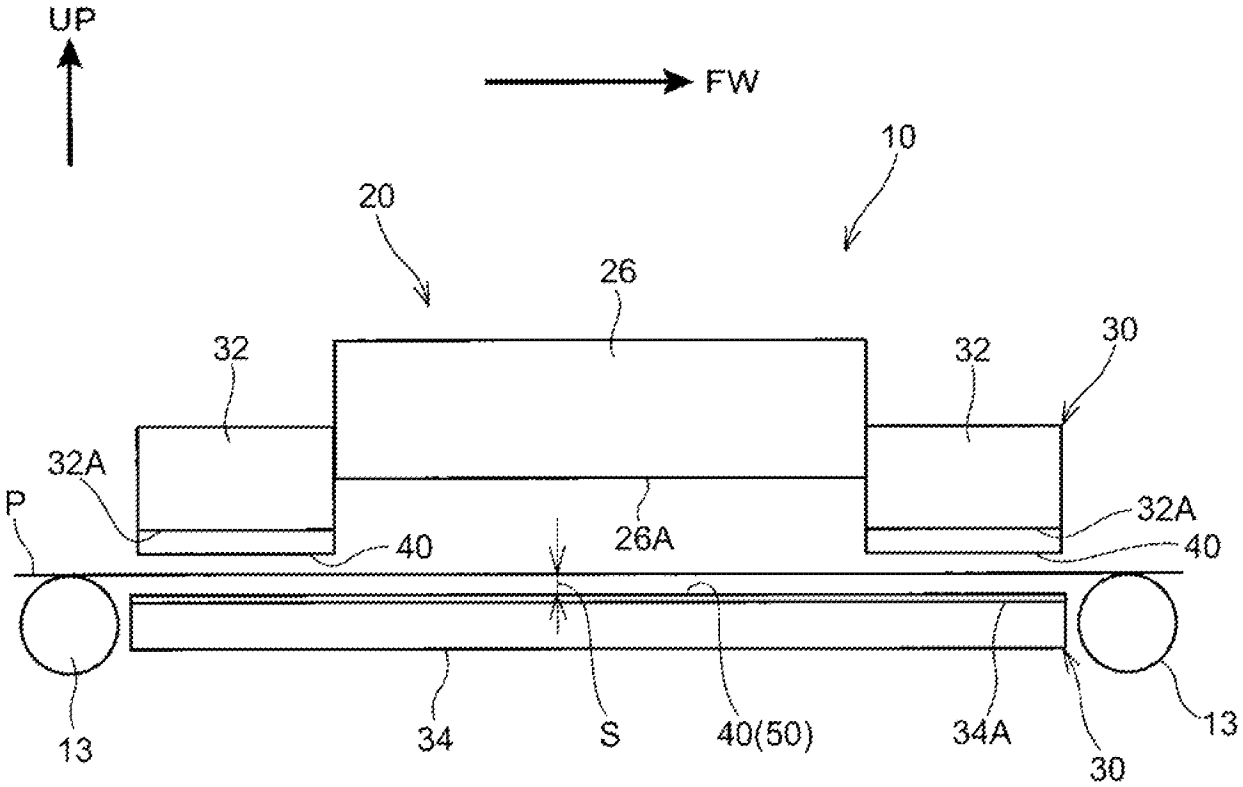
FIG. 4 is a side view illustrating a modified example of a lower light shielding portion of the light shielding member according to the first exemplary embodiment.

In addition, as illustrated on FIG. 2 and FIG. 4, a space portion S (gap in the vertical direction) is formed between the lower light shielding portion 34 and the continuous paper P. In other words, the position of the lower light shielding portion 34 is set so that the gap of 1 mm to 10 mm is formed between the lower light shielding portion 34 and the continuous paper P in the vertical direction and the continuous paper P is in non-contact with the lower light shielding portion 34. As illustrated in FIG. 4, the light absorbing portion 40 which absorbs the infrared laser beam transmitted through the continuous paper P may be provided on the upper surface 34A of the lower light shielding portion 34 facing the continuous paper P.

Here, if the light absorbing portion 40 is provided on the upper light shielding portion 32 and the lower light shielding portion 34, there is a possibility of excessive increase in the temperature of the upper light shielding portion 32 and the lower light shielding portion 34 (for example, to the temperature which is equal to or greater than 70° C.). Therefore, a cooling unit 42 of an air cooling type which is illustrated in FIG. 5 or a water cooling type which is illustrated in FIG. 6 may be provided on the upper light shielding portion 32 or the lower light shielding portion 34.

Figure 5:
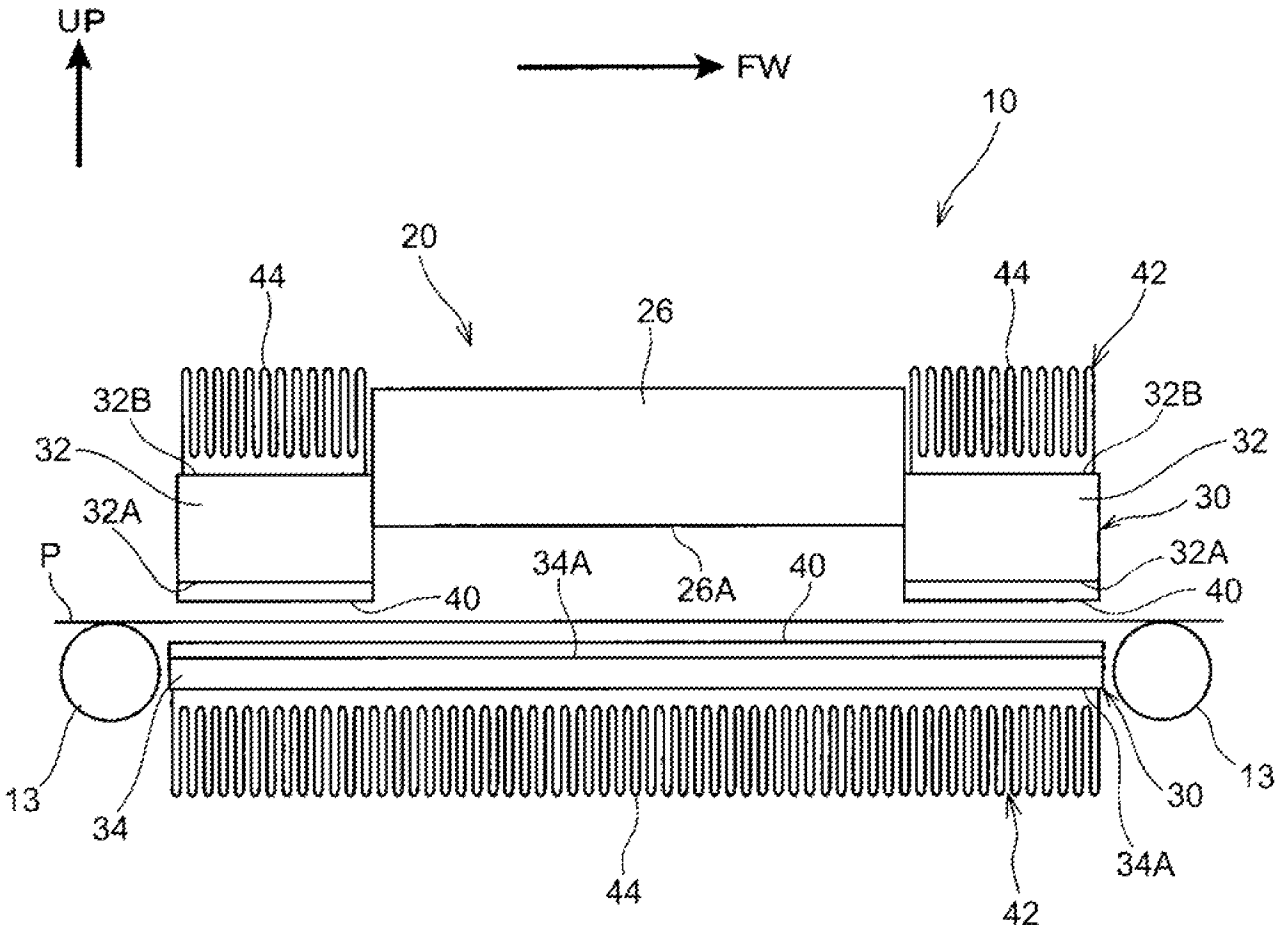
FIG. 5 is a side view illustrating an air-cooling type cooling unit of the light shielding member according to the first exemplary embodiment.

Specifically, as illustrated in FIG. 5, a fin 44 for increasing a surface area is formed on the upper surface 32B of the upper light shielding portion 32 or the lower surface 34B of the lower light shielding portion 34 and a cooling air is supplied from a blower (not illustrated) to the fin 44 and thus the upper light shielding portion 32 or the lower light shielding portion 34 may be configured to exchange heat with the cooling air (is cooled by the cooling air).

Figure 6:
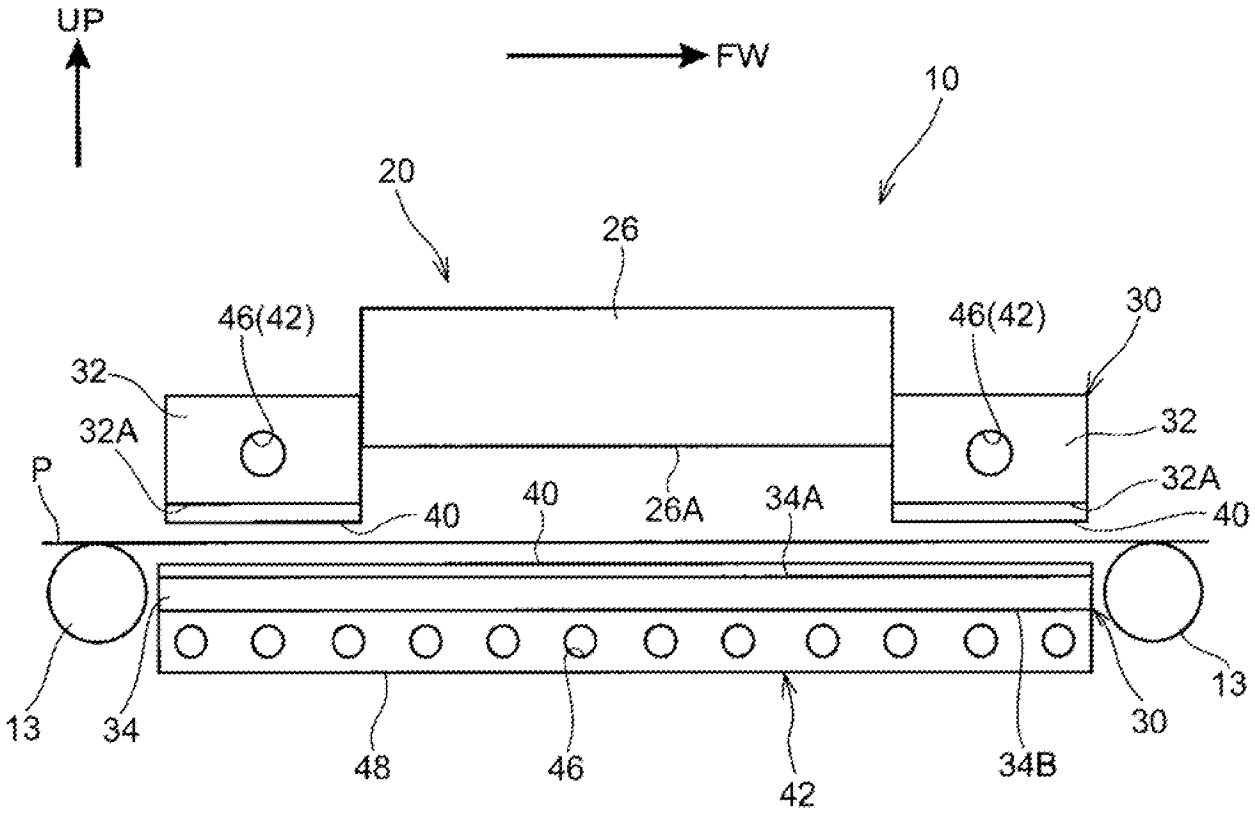
FIG. 6 is a side view illustrating a water-cooling type cooling unit of the light shielding member according to the first exemplary embodiment.

In addition, as illustrated in FIG. 6, a flow path 46 having a section of circular shape in which the cooling water flows directly forms on the upper light shielding portion 32 and the upper light shielding portion 32 may be configured to exchange heat with the cooling water flowing through the flow path 46 (is cooled by the cooling water). Therefore, a flow path member 48 which has the flow path 46 having a section of circular shape in which the cooling water flows is integrally provided on the lower surface 34B of the lower light shielding portion 34 and thus the lower light shielding portion 34 may be configured to exchange heat with the cooling water flowing the flow path 46 (is cooled by the cooling water).

In addition, even if not illustrated, a plate thickness of the lower light shielding portion 34 may be formed to be thicker than a thickness of the illustrated plate, the flow path 46 having a section of circular shape in which the cooling water flows may be formed in the lower light shielding portion 34, and lower light shielding portion 34 may exchange heat with the cooling water flowing the flow path 46 (is cooled by the cooling water). In a case where the light absorbing portion 40 is not provided on the upper surface 34A of the lower light shielding portion 34, the cooling unit 42 may not be provided in the lower light shielding portion 34. In addition, in a case where the light absorbing portion 40 is provided on the lower surface of the holding member 24, preferably, the cooling unit 42 is also provided in the holding member 24.

In addition, there is no the light absorbing portion 40 on the upper surface 34A of the lower light shielding portion 34 facing the continuous paper P and a reflecting portion 50 (see FIG. 4) which irradiates the continuous paper P by reflecting the infrared laser beam transmitting through the continuous paper P may be provided on the upper surface 34A of the lower light shielding portion 34 facing the continuous paper P. In other words, the evaporation of the moisture in an image (ink droplets) formed on the upper surface of the continuous paper P may be accelerated by the infrared laser beam which is reflected from the reflecting portion 50 of the lower light shielding portion 34 being irradiated to the lower surface of the continuous paper P.

In the inkjet recording device 10 according to the first exemplary embodiment configured as described above, next operation thereof will be described.

If a printing job is performed in the inkjet recording device 10, the ink droplets ejects from each inkjet recording head 22 to the continuous paper P fed from the sending portion 16 in each accommodation chamber 12. Accordingly, an image is formed on the upper surface of the continuous paper P (on the both the surface and the back surface of the continuous paper P).

If an image is formed on the continuous paper P in each accommodation chamber 12, the infrared laser beam is irradiated to the continuous paper P by the irradiating portion 26. Accordingly, a temperature of the moisture in an image, that is, the ink droplets formed on the upper surface of the continuous paper P is instantly (in a few tens of milliseconds to several hundred milliseconds) increased to the boiling temperature and thus the moisture in the ink droplets is evaporated. Accordingly, bleeding is reduced by the moisture being penetrated into the constant paper P and reduction of optical density of an image is inhibited or prevented.

In particular, the irradiating portion 26 is disposed on the upper side of the transport path in order to irradiate with the infrared laser beam from the normal direction of the continuous paper P in the side view viewed from the width direction of the continuous paper P. Therefore, the evaporation of the moisture in an image (ink deposits) formed on the upper surface of the continuous paper P is accelerated, unlike in a configuration in which the irradiating portion 26 irradiates the continuous paper P in the normal direction beam from the inclined upper side with the infrared laser.

In addition, the fitting portion 36 of the upper light shielding portion 32 and the fitted portion 38 of the lower light shielding portion 34 are fitted with each other on the outside of the irradiating portion 26 in the width direction. In other words, the labyrinthine structure Ls is formed on the mating surface between the fitting portion 36 and the fitted portion 38 in the outside of the irradiating portion 26 in the width direction. Therefore, the infrared laser beam is inhibited or prevented from being leaked to the outside of the irradiating portion 26 in the width direction, unlike in a case where the labyrinthine structure Ls is not formed on the outside of the irradiating portion 26 in the width direction.

In addition, the light absorbing portion 40 of which each length D in the transport direction is equal to or greater than 20 mm is provided on the lower surface 32A of the upper light shielding portion 32 disposed on the upstream side and the downstream side of the irradiating portion 26 in the transport portion. Therefore, the infrared laser beam reflected from the upper surface of the continuous paper P is absorbed at the light absorbing portion 40. Therefore, the infrared laser beam is inhibited from being leaked to the upstream side and the downstream side in the transport direction than the light shielding member 30 (upper light shielding portion 32), unlike in a case where the light absorbing portion 40 is not provided on the lower surface 32A of the upper light shielding portion 32 in the upstream side and the downstream side of the irradiating portion 26 in the transport direction.

In addition, the space portion S is formed between the continuous paper P and the lower light shielding portion 34. In other words, the upper surface 34A of the lower light shielding portion 34 (including the light absorbing portion 40 or the reflecting portion 50) is not in contact with the lower surface of the continuous paper P. Therefore, heat of the ink droplets of which temperature is increased by the infrared laser beam is prevented from being escaped from the continuous paper P to the lower light shielding portion 34, unlike in a configuration in which the upper surface 34A of the lower light shielding portion 34 is in contact with the lower surface of the continuous paper P. Therefore, the temperature of the ink droplets landed on the upper surface of the continuous paper P is effectively increased and the evaporation of the moisture in the ink droplets is accelerated (the drying efficiency of the ink droplets is improved).

In addition, if the light absorbing portion 40 is provided on the upper surface 34A of the lower light shielding portion 34, the temperature of the lower light shielding portion 34 is increased since the infrared laser beam which transmits through the continuous paper P is absorbed to the light absorbing portion 40 of the lower light shielding portion 34. Therefore, the ink droplets landed on the upper surface of the continuous paper P are warmed up from the lower surface, by radiation heat from the lower light shielding portion 34, unlike in a case where the light absorbing portion 40 is not provided on the upper surface 34A of the lower light shielding portion 34. Therefore, the temperature of the ink droplets landed on the upper surface of the continuous paper P is further effectively increased and thus the evaporation of the moisture in the ink droplets is further accelerated (the drying efficiency of the ink droplets is further improved).

In addition, if the reflecting portion 50 is provided on the upper surface 34A of the lower light shielding portion 34, the ink droplets landed on the upper surface of the continuous paper P are also warmed up from the lower surface side since the infrared laser beam transmitting through the continuous paper P is reflected by the reflecting portion 50 and then is irradiated to the lower surface of the continuous paper P. Therefore, the evaporation of the moisture in the ink droplets is further accelerated by the temperature of the ink droplets landed on the upper surface of the continuous paper P being further effectively increased, unlike in a case where the reflecting portion 50 is not provided on the upper surface 34A of the lower light shielding portion 34. If the continuous paper P is configured to be also warmed up from the lower surface side, there is an advantage of output of the infrared laser beam being capable of being reduced.

In addition, if the cooling unit 42 is provided on the upper light shielding portion 32 on which the light absorbing portion 40 is provided, excessive increase in the temperature of the upper light shielding portion 32 is inhibited. Therefore, if the cooling unit 42 is provided on the lower light shielding portion 34 on which the light absorbing portion 40 is provided, excessive increase in the temperature of the lower light shielding portion 34 is inhibited. Accordingly, even if an operator is in contact with the upper light shielding portion 32 or the lower light shielding portion 34, safety of the operator is ensured.

In addition, the lower surface 26A (glass plate) of the irradiating portion 26 is positioned on a position which is higher than the lower surface 32A of the upper light shielding portion 32. Therefore, the ink droplets which are landed on the upper surface of the continuous paper P are inhibited or prevented from being attached on the lower surface 26A (glass plate) of the irradiating portion 26, unlike in a case where the lower surface 26A (glass plate) of the irradiating portion 26 and the lower surface 32A of the upper light shielding portion 32 are disposed at the same height position with each other. Therefore, contamination of the lower surface 26A (glass plate) of the irradiating portion 26 or cracking by temperature difference between a portion to which the ink droplets are attached and a portion to which the ink droplets are not attached is inhibited or prevented.

In addition, the maintenance job with respect to the irradiating portion 26 is facilitated and the maintenance job with respect to the upper light shielding portion 32 or the lower light shielding portion 34 is facilitated, unlike in a case where the upper light shielding portion 32 is fixedly disposed together with the irradiating portion 26 since the upper light shielding portion 32 is configured to be capable of being lifted and being moved in the width direction integrally with the irradiating portion 26.

In addition, in the inkjet recording device 10, if the door 14 of the accommodation chamber 12 is not closed, since the interlock mechanism to which the infrared laser beam is not irradiated from the irradiating portion 26 is provided, the infrared laser beam is prevented from being leaked from the accommodation chamber 12 to the outside, unlike in a case where the interlock mechanism is not provided.

If the control portion does not detect that the fitting portion 36 of the upper light shielding portion 32 and the fitted portion 38 of the lower light shielding portion 34 are fitted to each other, the interlock mechanism may be configured not to be energized to the irradiating portion 26 and if the control portion does not detect that the continuous paper P is transported, the interlock mechanism may be configured not to be energized to the irradiating portion 26. Even in the interlock mechanism, the infrared laser beam is prevented from being leaked to the outside of the accommodation chamber 12.

Second Exemplary Embodiment:

Next, an inkjet recording device 10 according to a second exemplary embodiment will be described. The same reference numerals denote to portions which are the same as those of the first exemplary embodiment and detail description (including operations in common) will be appropriately omitted.

Figure 7:
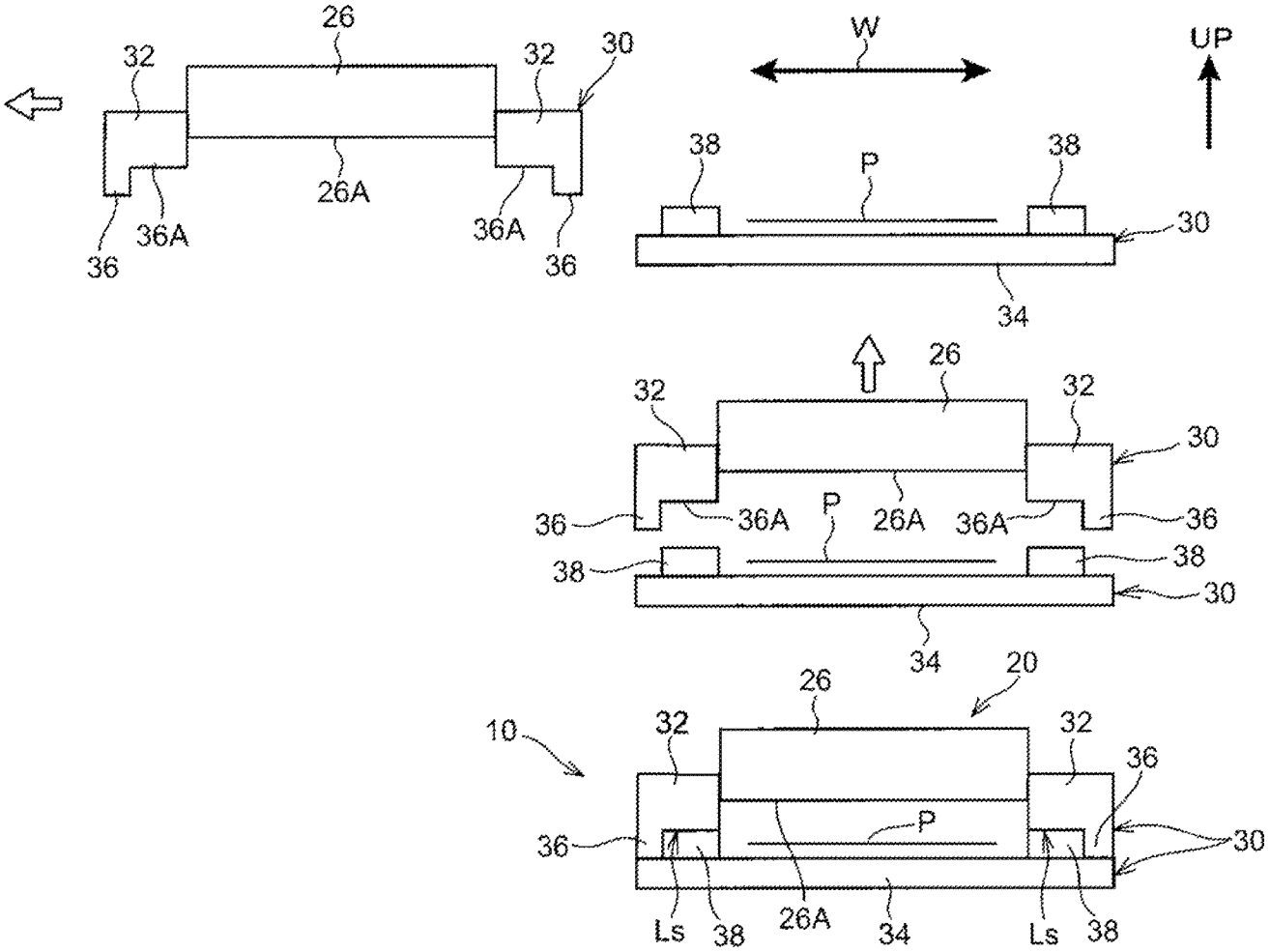
FIG. 7 is an explanation view illustrating a configuration of an outside portion of a light shielding member in the width direction according to a second exemplary embodiment.

As illustrated in FIG. 7, the shape of the fitting portion 36 of the upper light shielding portion 32 and the shape of the fitted portion 38 of the lower light shielding portion 34 have a shape opposite to the shape of the first exemplary embodiment, in the inkjet recording device 10 according to the second exemplary embodiment. In other words, the fitting portion 36 of the upper light shielding portion 32 has a section of a substantially "L" shape of which the inside in the width direction is cut and a notch portion 36A of the fitting portion 36 is configured to be fitted to the fitted portion 38 having a section of a rectangular shape of the lower light shielding portion 34.

The light shielding member 30 having a tunnel shape through which the continuous paper P is capable of being passed in the transport direction is also provided on the fitting portion 36 and the fitted portion 38 having such a shape and the labyrinthine structure Ls is formed on the outside of the continuous paper P in the width direction (the outside part of the light shielding member 30 in the width direction). Therefore, the leakage of the infrared laser beam at least in the width direction of the continuous paper P is inhibited or prevented even in the inkjet recording device 10 according to the second exemplary embodiment.

Third Exemplary Embodiment:

Next, an inkjet recording device 10 according to a third exemplary embodiment will be described. The same reference numerals denote to portions which are the same as those of the first exemplary embodiment and the second exemplary embodiment and detail description (including operations in common) will be appropriately omitted.

Figure 8:
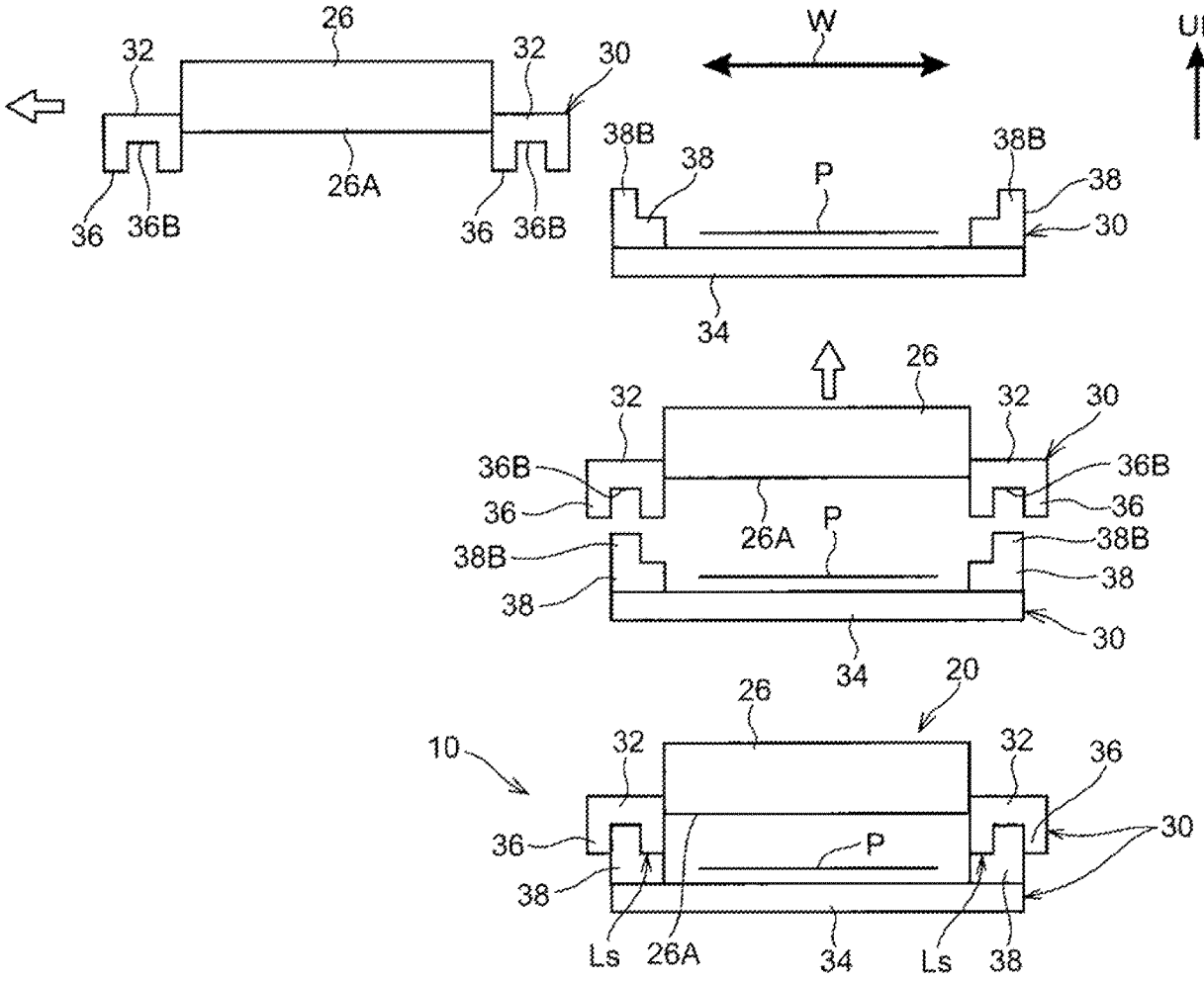
FIG. 8 is an explanation view illustrating a configuration of an outside portion of a light shielding member in the width direction according to a third exemplary embodiment.

As illustrated in FIG. 8, in the inkjet recording device 10 according to the third exemplary embodiment, the shape of the fitting portion 36 of the upper light shielding portion 32 is different from the shape of the first exemplary embodiment. In other words, the fitting portion 36 of the upper light shielding portion 32 has a section of a substantially inverted "concave" shape and the concave portion 36B of the fitting portion 36 is configured to be fitted to a projection portion 38B (having a section of a substantially L shape) of the fitted portion 38 of the lower light shielding portion 34.

The light shielding member 30 having a tunnel shape through which the continuous paper P is capable of being passed is configured in the fitting portion 36 and the fitted portion 38 having such a shape and a more complicated (having a lot of bending) labyrinthine structure Ls than those of the first exemplary embodiment and the second exemplary embodiment is formed on the outside of the continuous paper P in the width direction (an outside part of the light shielding member 30 in the width direction). Therefore, the leakage of the infrared laser beam at least in the width direction of the continuous paper P is further inhibited or prevented than in the inkjet recording device 10 according to the third exemplary embodiment.

Fourth Exemplary Embodiment:

Next, an inkjet recording device 10 according to a fourth exemplary embodiment will be described. The same reference numerals denote to portions which are the same as those of the first exemplary embodiment and to the third exemplary embodiment and detail description (including operations in common) will be appropriately omitted.

Figure 9:
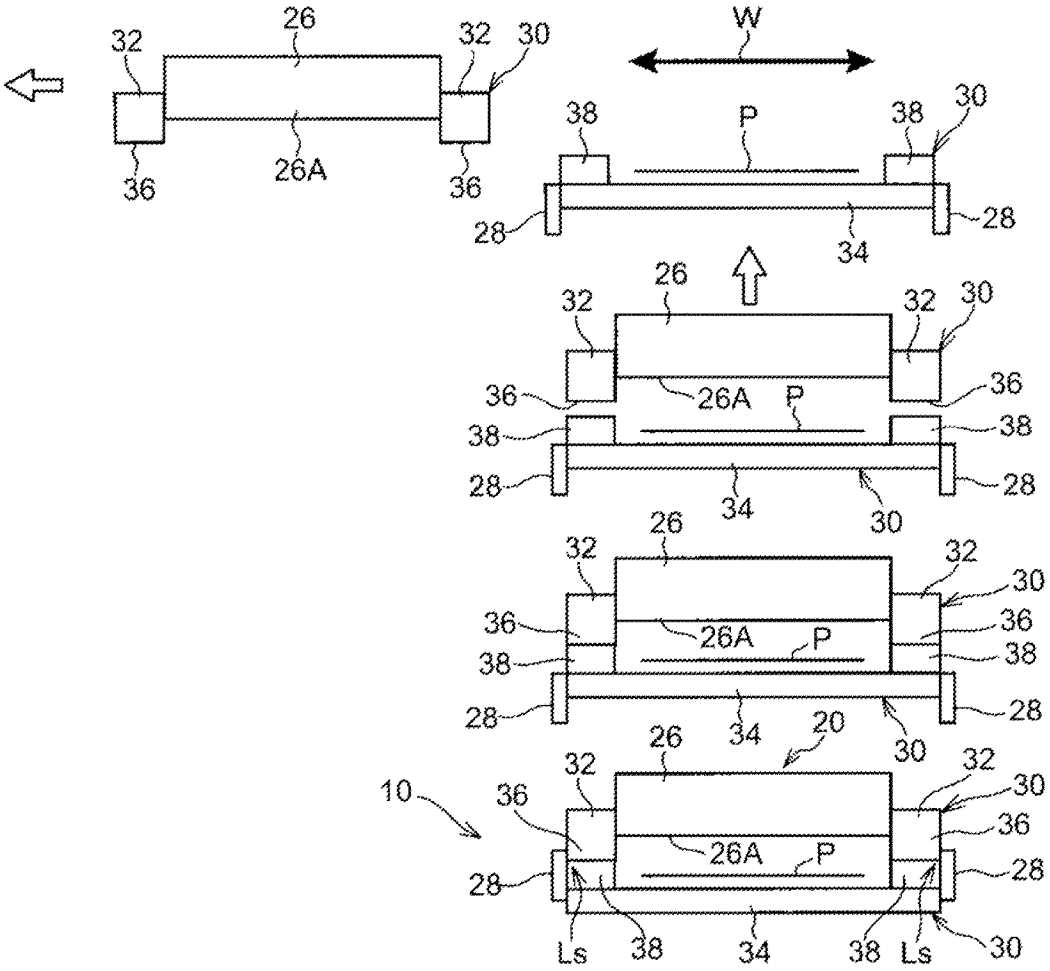
FIG. 9 is an explanation view illustrating a configuration of an outside portion of a light shielding member in the width direction according to a fourth exemplary embodiment.

As illustrated in FIG. 9, a shape of the fitted portion 38 of the lower light shielding portion 34 is different from that of the first exemplary embodiment in the inkjet recording device 10 according to the fourth exemplary embodiment. In other words, the fitted portion 38 of the lower light shielding portion 34 also has a section of a rectangular shape and the lower surface of the fitting portion 36 and the upper surface of the fitted portion 38 are configured to be in contact with each other.

Therefore, a side light shielding portion 28 which covers a side surface of the outside of the fitting portion 36 and the fitted portion 38 in the width direction which are in contact with each other is provided on the inkjet recording device 10 according to the fourth exemplary embodiment. The side light shielding portion 28 has a flat surface shape which has the same length as the length along the transport direction of the fitted portion 38 in the lower light shielding portion 34 and is configured to be capable of lifting by a rotating eccentric cam, an air cylinder or the like.

The side light shielding portion 28 covers an end portion in the width direction of the mating surface between the lower surface of the fitting portion 36 and the upper surface of the fitted portion 38 in a raised position from the outside in the width direction. In other words, the labyrinthine structure Ls is formed on the outside of the continuous paper P in the width direction (an outside part of the light shielding member 30 in the width direction) by the side light shielding portion 28. Therefore, the leakage of the infrared laser beam at least in the width direction of the continuous paper P is inhibited or prevented even in the inkjet recording device 10 according to the fourth exemplary embodiment.

Hereinafter, the inkjet recording device 10 according to the present exemplary embodiments is described with reference to the drawings. However, the inkjet recording device 10 according to the present exemplary embodiments is not limited to that illustrated in the drawings and appropriately design changes may be performed within the scope not departing from the gist of the present invention. For example, the recording medium is not limited to the continuous paper P and may also include a cut paper (normal paper).

In addition, the inkjet recording device 10 according to the present exemplary embodiment is the inkjet recording device 10 of full color, but may be the inkjet recording device 10 of monochrome. In this case, as illustrated in FIG. 2, the inkjet recording device 10 corresponds to only the inkjet recording head 22 of black (K). In addition, in the inkjet recording device 10 according to the present exemplary embodiment, only one accommodation chamber 12 is provided and thus only a single-surface printing may be performed.

In addition, the irradiating portion 26 is not limited to as a configuration which is provided only on the downstream side of the inkjet recording head 22 of black (K) and may be a configuration which is provided on the downstream side of each inkjet recording head 22 of cyan (C), magenta (M) and yellow (Y), respectively. In addition, the order of colors is not limited to the order of black (K), cyan (C), magenta (M) and yellow (Y).

In addition, the holding member 24 may be provided integrally with the upper light shielding portion 32. In other words, the inkjet recording head 22 is not limited to a configuration in which is capable of lifting or moving independently of the irradiating portion 26 and may be configured to be capable of being lifted or being moved together with the irradiating portion 26.

In addition, the light absorbing portion 40 may be provided on the side surface of an inside of the fitting portion 36 of the upper light shielding portion 32 and the fitted portion 38 of the lower light shielding portion 34 in the width direction. Furthermore, the lower surface 26A of the irradiating portion 26 is disposed on the upper side position than the lower surface 32A of the upper light shielding portion 32. However, it is not limited to this. The lower surface 26A of the irradiating portion 26 and the lower surface 32A of the upper light shielding portion 32 may be disposed on the same height position with each other.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A droplet ejection device comprising:

a droplet ejection head that ejects a droplet to a recording medium;

an irradiating portion that is disposed closer to a downstream side of the recording medium in a transport direction of the recording medium than the droplet ejection head and evaporates moisture of the droplet landed on the recording medium by irradiating the recording medium with an infrared laser beam; and a light shielding member that includes an upper light shielding portion which is provided on a perimeter of the irradiating portion and a lower light shielding portion which is provided on a position facing the irradiating portion and the upper light shielding portion while placing the recording medium between the upper light shielding portion and the lower light shielding portion, wherein the upper light shielding portion and the lower light shielding portion are in contact with each other outside of the recording medium in the width direction so that the light shielding member shields the infrared laser beam at least in the width direction of the recording medium.

2. The droplet ejection device according to claim 1, wherein a lower surface of the irradiating portion is disposed at a higher position than the lower surface of the upper light shielding portion.

3. The droplet ejection device according to claim 1, further comprising:

an accommodation chamber that accommodates the droplet ejection head, the irradiating portion and the light shielding portion and is capable of being opened and closed, wherein the infrared laser beam is not radiated from the irradiating portion in a state where the accommodation chamber is opened.

4. The droplet ejection device according to claim 1, wherein the upper light shielding portion is configured to be capable of lifting integrally with the irradiating portion and to be capable of moving in the width direction of the recording medium.

5. The droplet ejection device according to claim 1, further comprising a first light absorbing portion that absorbs the infrared laser beam reflected from the recording medium and that is provided closer to a lower surface of the upper light shielding portion in the upstream side and the downstream side of the recording medium in the transport direction than the irradiating portion.

6. The droplet ejection device according to claim 5, further comprising a second light absorbing portion that absorbs the infrared laser beam transmitted through the recording medium and that is provided on an upper surface of the lower light shielding portion that faces the recording medium.

7. The droplet ejection device according to claim 5, further comprising:

a second light absorbing portion that absorbs the infrared laser beam transmitted through the recording medium and that is provided on an upper surface of the lower light shielding portion that faces the recording medium; and a second cooling unit that cools the lower light shielding portion.

8. The droplet ejection device according to claim 5, further comprising a first cooling unit that cools the upper light shielding portion.

9. The droplet ejection device according to claim 8, wherein the first cooling unit is one of an air cooling type and a water cooling type.

10. The droplet ejection device according to claim 8, further comprising a second cooling unit that cools the lower light shielding portion.

11. The droplet ejection device according to claim 10, wherein the second cooling unit is one of an air cooling type and a water cooling type.

12. The droplet ejection device according to claim 1, wherein a space portion is formed between the lower light shielding portion and the recording medium.

13. The droplet ejection device according to claim 12, further comprising a reflecting portion that reflects the infrared laser beam transmitted through the recording medium to radiate to the recording medium and that is provided on the upper surface of the lower light shielding portion that faces the recording medium.

* * * * *